US007828821B2

(12) United States Patent
Renz

(10) Patent No.: US 7,828,821 B2
(45) Date of Patent: Nov. 9, 2010

(54) NIPPLE

(75) Inventor: Charles J. Renz, Briarcliff Manor, NY (US)

(73) Assignee: Playtex Products, Inc., Westport, CT (US)

( * ) Notice: Subject to any disclaimer, the term of this patent is extended or adjusted under 35 U.S.C. 154(b) by 0 days.

(21) Appl. No.: 10/658,308

(22) Filed: Sep. 9, 2003

(65) Prior Publication Data

US 2005/0247658 A1 Nov. 10, 2005

Related U.S. Application Data

(63) Continuation of application No. 10/054,510, filed on Nov. 13, 2001, now Pat. No. 6,645,228.

(51) Int. Cl.
*A61J 17/00* (2006.01)

(52) U.S. Cl. ..... 606/236; 215/11.5

(58) Field of Classification Search ..... 606/236, 606/234, 235; 215/11.5, 11.4
See application file for complete search history.

(56) References Cited

U.S. PATENT DOCUMENTS

| | | | | |
|---|---|---|---|---|
| 956,741 | A | 5/1910 | Smith | |
| 1,099,082 | A | 6/1914 | Decker | |
| 1,541,330 | A | 6/1925 | Decker | |
| 1,858,356 | A | 5/1932 | Brown | |
| 2,196,870 | A | 4/1940 | Little | 128/252 |
| D130,791 | S | 12/1941 | Porthouse et al. | |
| 2,269,223 | A | 1/1942 | Porthouse et al. | 128/252 |
| 2,509,129 | A | 5/1950 | Buck | 215/11 |
| 2,741,385 | A | 4/1956 | Raiche | 215/11 |
| 2,960,088 | A * | 11/1960 | Witz | 215/11.4 |
| 2,977,013 | A | 3/1961 | Clemens | 215/11 |
| 3,203,569 | A | 8/1965 | Shomock et al. | 215/11 |
| 3,211,315 | A | 10/1965 | Griesinger | 215/11 |
| 3,272,202 | A | 9/1966 | Soto | 128/252 |
| 3,664,535 | A | 5/1972 | Mette | 215/11 R |
| 3,677,429 | A | 7/1972 | La Barge | 215/11 C |
| 3,777,753 | A | 12/1973 | Kesselring et al. | 128/252 |
| 4,238,040 | A | 12/1980 | Fitzpatrick | 215/11.3 |
| D271,797 | S | 12/1983 | Chrones | D24/196 |
| 4,505,398 | A | 3/1985 | Kesselring | 215/11.5 |
| D286,071 | S | 10/1986 | Fuller | D24/46 |

(Continued)

FOREIGN PATENT DOCUMENTS

| | | |
|---|---|---|
| CN | 1324423 | 11/2001 |

OTHER PUBLICATIONS

Chinese Office Action dated Apr. 24, 2009 from Chinese Patent Application No. 200380102488.9.

*Primary Examiner*—Kevin T Truong
(74) *Attorney, Agent, or Firm*—Ohlandt, Greeley, Ruggiero & Perle, L.L.P.

(57) ABSTRACT

A nipple simulating the shape and function of a woman's breast is provided. The nipple has a stem and a base. The nipple preferably has a securing structure integrally formed to the base. The base has an areola region and a bulbous region. The areola region is positioned between the stem and the bulbous region, and is designed to simulate the shape of the areola region of a woman's breast. The bulbous region is positioned between the areola region and the securing structure, and is designed to simulate the shape of the region of a woman's breast surrounding the areola region.

8 Claims, 4 Drawing Sheets

U.S. PATENT DOCUMENTS

| | | | | |
|---|---|---|---|---|
| D288,240 | S | 2/1987 | Fuller | D24/46 |
| D288,241 | S | 2/1987 | Fuller | D24/46 |
| 4,676,386 | A | 6/1987 | Phlaphongphanich | 215/11 R |
| D294,735 | S | 3/1988 | Morano et al. | D24/196 |
| D300,462 | S | 3/1989 | English et al. | D24/45 |
| 4,834,099 | A | 5/1989 | Schrooten | 128/360 |
| D303,839 | S | 10/1989 | Fitzpatrick et al. | D24/194 |
| 5,024,341 | A | 6/1991 | Dekerle | 215/11.1 |
| 5,101,991 | A * | 4/1992 | Morifuji et al. | 215/11.1 |
| 5,129,532 | A | 7/1992 | Martin | 215/11.1 |
| D330,938 | S | 11/1992 | Sakashita | D24/196 |
| 5,269,426 | A | 12/1993 | Morano | 215/11.6 |
| 5,419,445 | A | 5/1995 | Kaesemeyer | 215/11.1 |
| D360,468 | S | 7/1995 | Fuller | D24/196 |
| 5,553,726 | A | 9/1996 | Park | 215/11.4 |
| 5,617,972 | A | 4/1997 | Morano et al. | 221/33 |
| D381,752 | S | 7/1997 | McCoy | D24/196 |
| 5,653,732 | A | 8/1997 | Sheehy | 606/236 |
| 5,747,083 | A | 5/1998 | Raymond et al. | 426/117 |
| 5,806,711 | A | 9/1998 | Morano et al. | 221/33 |
| D405,530 | S | 2/1999 | Manganiello et al. | D24/196 |
| 5,878,899 | A | 3/1999 | Manganiello et al. | 215/11.6 |
| 5,881,893 | A | 3/1999 | Manganiello | 215/11.5 |
| D411,886 | S | 7/1999 | Manganiello | D24/197 |
| 5,921,426 | A | 7/1999 | Randolph | 220/495.06 |
| D412,582 | S | 8/1999 | Morano | D24/197 |
| D417,275 | S | 11/1999 | Conforti | D24/130 |
| 6,003,698 | A | 12/1999 | Morano | 215/11.1 |
| 6,032,810 | A | 3/2000 | Meyers et al. | 215/11.1 |
| 6,041,950 | A | 3/2000 | Soehnlein | 215/11.1 |
| 6,053,342 | A | 4/2000 | Chomik | 215/11.5 |
| D433,143 | S | 10/2000 | Chomik et al. | D24/197 |
| 6,161,710 | A | 12/2000 | Dieringer et al. | 215/11.4 |
| D441,086 | S | 4/2001 | Morano | D24/197 |
| D441,870 | S | 5/2001 | Randolph | D24/196 |
| 6,253,935 | B1 * | 7/2001 | Fletcher | 606/236 |
| 6,325,817 | B1 | 12/2001 | Shen | 606/236 |
| D465,028 | S | 10/2002 | Renz | D24/196 |

* cited by examiner

NIPPLE

This application is a continuation of, and claims priority in, U.S. patent application Ser. No. 10/054,510, filed Nov. 13, 2001, which has issued as U.S. Pat. No. 6,645,228, the disclosure of which is incorporated herein by reference.

BACKGROUND OF THE INVENTION

1. Field of the Invention

The present invention relates to baby bottle nipples. More particularly, the present invention relates to baby bottle nipples that simulate a woman's breast.

2. Description of the Prior Art

Baby bottle nipples for feeding babies from bottles are known. Such devices allow mothers to bottle-feed their babies as a temporary or permanent alternative to breast-feeding. Babies become accustomed to the shape and function of a woman's breast during breast-feeding. Due to the significant differences in the shape and function between a woman's breast and conventional baby bottle nipples, babies experience difficulty in transitioning from breast-feeding to bottle-feeding. This can cause a baby to fail to take formula from a baby bottle nipple. Likewise, babies can grow accustomed to the shape and function of a particular conventional baby bottle nipple, creating difficulty for the baby to return to breast-feeding. This can cause a baby to fail to take milk from a woman's breast because of a developed preference for the shape and function of the baby bottle nipple.

In U.S. Pat. No. 5,653,732 to Sheehy, a nipple that claims to have a "natural form" is disclosed. The nipple has an annular rim; lower, intermediate and upper segments; and a tip. The annular rim is used as a securing structure and is adjacent to and integrally formed with the lower segment having a large curved outer surface. The lower segment is adjacent to and integrally formed with the intermediate segment that has a smaller curved outer surface and is smaller than the lower segment. The intermediate segment is adjacent to and integrally formed with the upper segment that has a smaller curved outer surface than the intermediate segment. The upper segment is adjacent to and integrally formed with the tip. The disclosed nipple suffers from the drawback of having three segments or areas that do not simulate the shape and function of a woman's breast.

SUMMARY OF THE INVENTION

It is an object of the present invention to provide a nipple with an improved design.

It is another object of the present invention to provide a nipple that assists babies in the transition between breast-feeding and bottle-feeding.

It is still another object of the present invention to provide such a nipple with a shape and function simulating a woman's breast.

These and other objects and advantages of the present invention are provided by a nipple that comprises a tapered stem that is connected to a base that is further connected to a securing structure. The base comprises an areola region and a bulbous region. The areola region is positioned between the stem and the bulbous region, and is designed to simulate the shape of the areola region of a woman's breast. The bulbous region is positioned between the areola region and the securing structure, and is designed to simulate the shape of the region of a woman's breast surrounding the areola region.

Other and further objects, advantages and features of the present invention will be understood by reference to the following.

DESCRIPTION OF THE INVENTION

Figure 1:
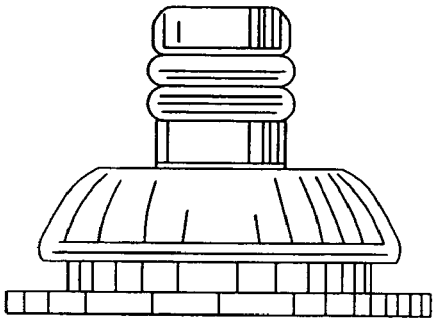
Fig. 1 (Prior Art)
FIG. 1 is a plan view of a prior art PLAYTEX® conventional nipple.
Figure 2:
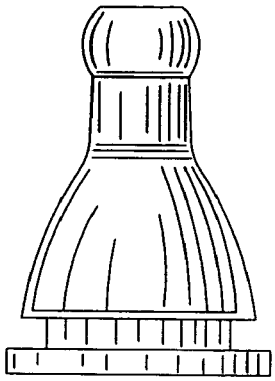
Fig. 2 (Prior Art)
FIG. 2 is a plan view of a prior art EVENFLO® conventional nipple.
Figure 3:
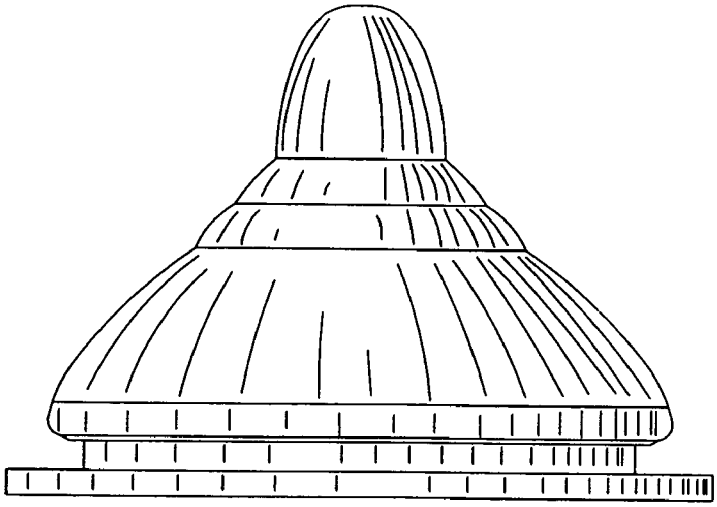
Fig. 3 (Prior Art)
FIG. 3 is a plan view of the nipple disclosed in U.S. Pat. No. 5,653,732.

Referring to the drawings and, in particular, FIGS. 1 through 3, there is shown the prior art. FIG. 1 is a commercial PLAYTEX® nipple. FIG. 2 is a commercial EVENFLO® nipple. Both of these nipples do not simulate the shape and function of a woman's breast. FIG. 3 is the nipple of U.S. Pat. No. 5,653,732. This nipple has three separate segments and a tip. This prior art nipple also does not simulate the shape and function of a woman's breast.

Figure 4:
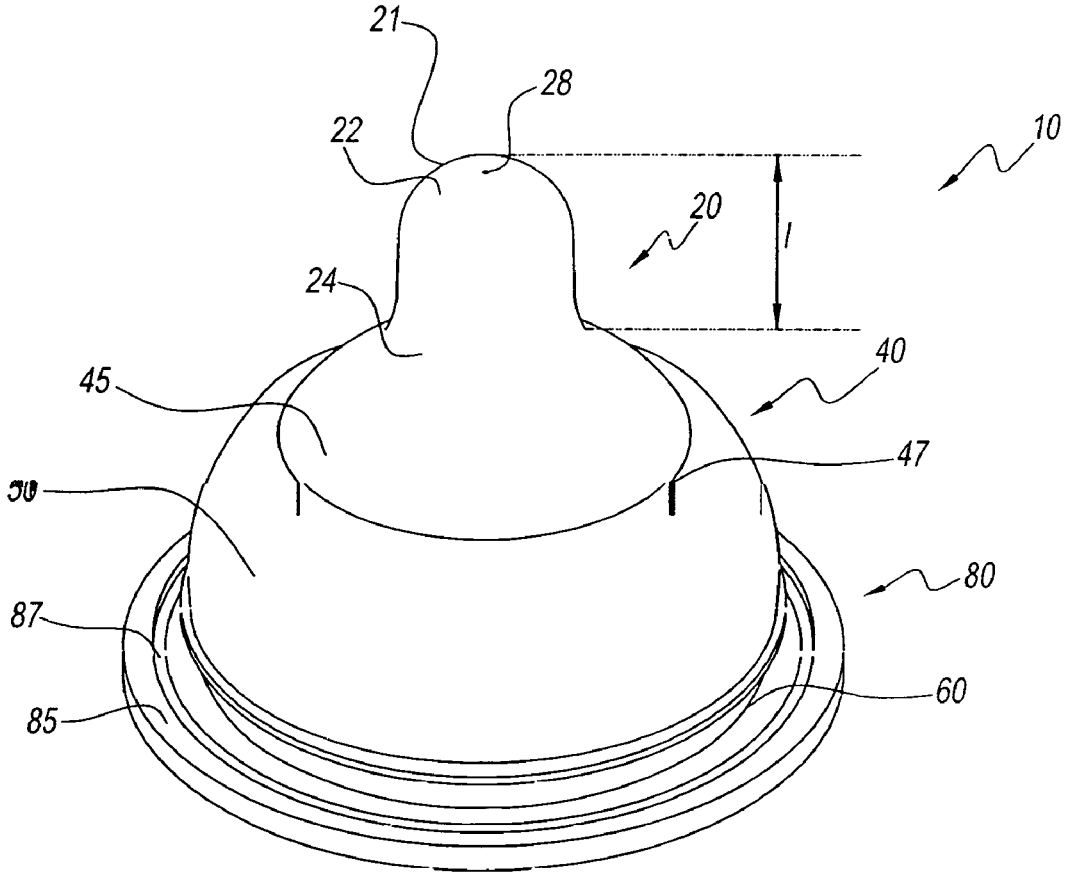
FIG. 4 is a perspective view of the nipple of the present invention.

Referring to FIG. 4, there is shown an embodiment of a nipple of the present invention generally represented by reference numeral 10. Nipple 10 has a stem 20 and a base 40 connected to the stem. Nipple 10 preferably also has a securing structure 80.

Figure 5:
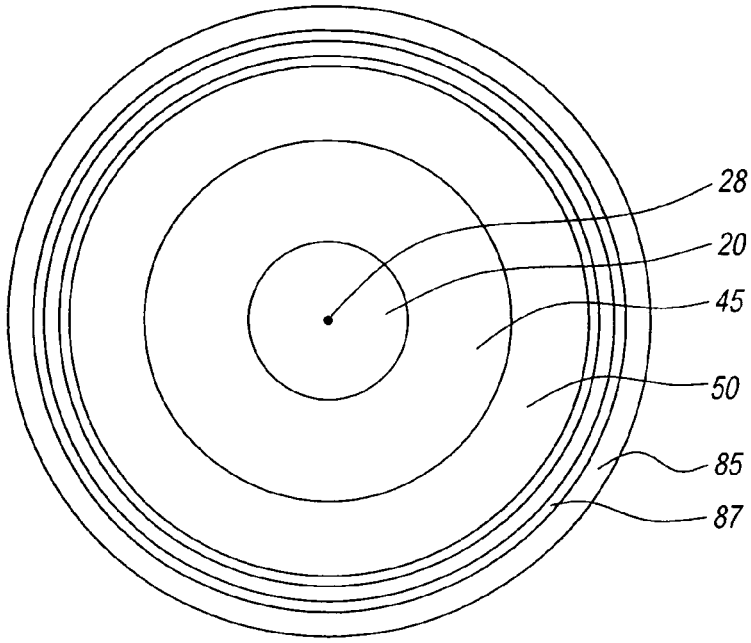
FIG. 5 is a top view of the nipple of FIG. 4.
Figure 6:
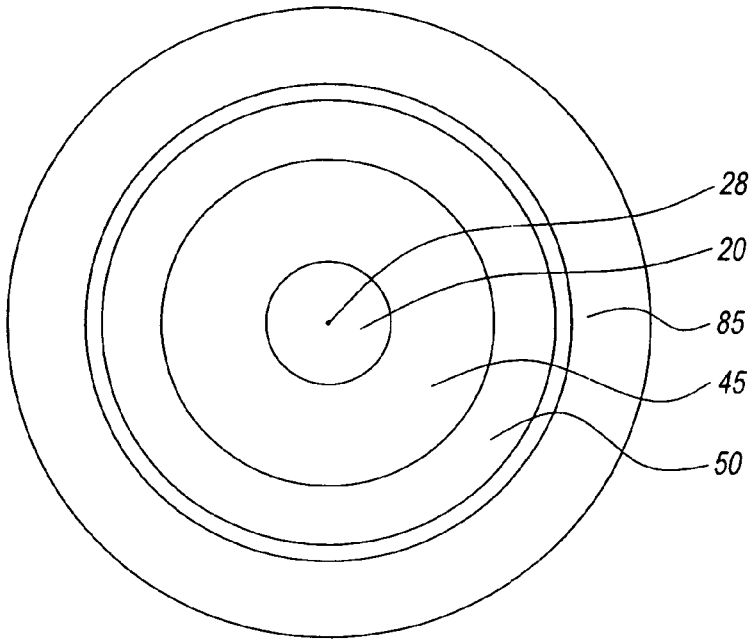
FIG. 6 is a bottom view of the nipple of FIG. 4.

Referring to FIGS. 4 and 5, stem 20 has a first end 22, a second end 24 and a length 1. Base 40 has an areola region 45 and a bulbous region 50.

Stem 20 is substantially cylindrical in shape and is tapered toward a curved apex surface 21 of first end 22. The tapered shape of stem 20 towards first end 22 promotes proper "latch on" by the baby. During breast-feeding, the baby latches on to the areola region of the woman's breast. Conventional nipples often promote latching on to the stem by having an indent located along the stem or being of a uniform cylindrical shape. This improper latching on promotes "nipple confusion," i.e., a baby forgets how to properly latch-on to a mother's breast. The present invention provides tapered stem 20 that promotes latching on to areola region 45. The tapered shape of stem 20 causes the baby to slide past the stem and on to areola region 45.

The present invention further provides an elongated stem 20. Stem 20 is elongated to simulate the extended stem of a woman's breast during breast-feeding, which has a shorter length when not breast-feeding. Preferably, length 1 is about 16.0 millimeters (mm) to about 26.0 mm. More preferably, length 1 is about 19.0 mm to about 23.0 mm.

First end 22 of stem 20 has curved apex surface 21 with at least one hole 28 located therethrough. Preferably, hole 28 is located at or about the center point of surface 21 and first end 22. Hole 28 preferably has a diameter about 0.15 mm to about 0.80 mm, and more preferably from about 0.22 mm to about 0.45 mm. Second end 24 preferably has a substantially circular shape. Preferably, first end 22 has a diameter of about 9.0 mm to about 16.0 mm, and second end 24 has a diameter of about 12.0 mm to about 23.0 mm. More preferably, first end 22 has a diameter of about 10.0 mm to about 14.0 mm, and second end 24 has a diameter of about 13.0 mm to about 16.0 mm. Preferably, stem 20 has a wall thickness of about 0.8 mm to about 2.0 mm. More preferably, stem 20 has a wall thickness of about 1.0 mm to about 1.4 mm.

Referring to FIGS. 4 through 7, second end 24 of stem 20 is secured to and surrounded by areola region 45 of base 40. Preferably, second end 24 is integrally formed with areola region 45. Areola region 45 is designed to simulate the areola region of a woman's breast. Areola region 45 has an outwardly curved shape providing a raised appearance and feel. This raised appearance and feel allows a baby to latch on to areola region 45 just as a baby would latch on to the areola region of a woman's breast during breast-feeding. Preferably, areola region 45 has a radius of curvature of about 3.5 mm to about 13.0 mm. More preferably, areola region 45 has a radius of curvature of about 5.0 mm to about 10.0 mm. Preferably, areola region 45 has a wall thickness of about 0.8 mm to about 2.0 mm. More preferably, areola region 45 has a wall thickness of about 1.0 mm to about 1.4 mm.

Areola region 45 is connected to and surrounded by bulbous region 50 along areola edge 47. Preferably, areola edge 47 is circular. More preferably, areola edge 47 has a diameter of about 26.0 mm to about 37.0 mm, and even more preferably a diameter of about 30.0 mm to about 35.0 mm. Preferably, areola region 45 is integrally formed with bulbous region 50 along areola edge 47. Bulbous region 50 is designed to simulate the region of a woman's breast that surrounds the areola region. Bulbous region 50 has an outwardly curved or convex shape. In the preferred embodiment, the surface area of bulbous region 50 is greater than the surface area of areola region 45. As shown in the top view of FIG. 5, areola region 45 is substantially concentrically aligned with bulbous region 50. Also, in the top view, stem 20 is substantially concentrically aligned with both areola region 45 and bulbous region 50. As shown in the front view of FIG. 7, second or proximal end 24 of stem 20 has opposing sides with inwardly concave shapes when viewed in the front view. Areola region 45 and second end 24 of stem 20 are connected along an inwardly smooth concave surface.

Figure 7:
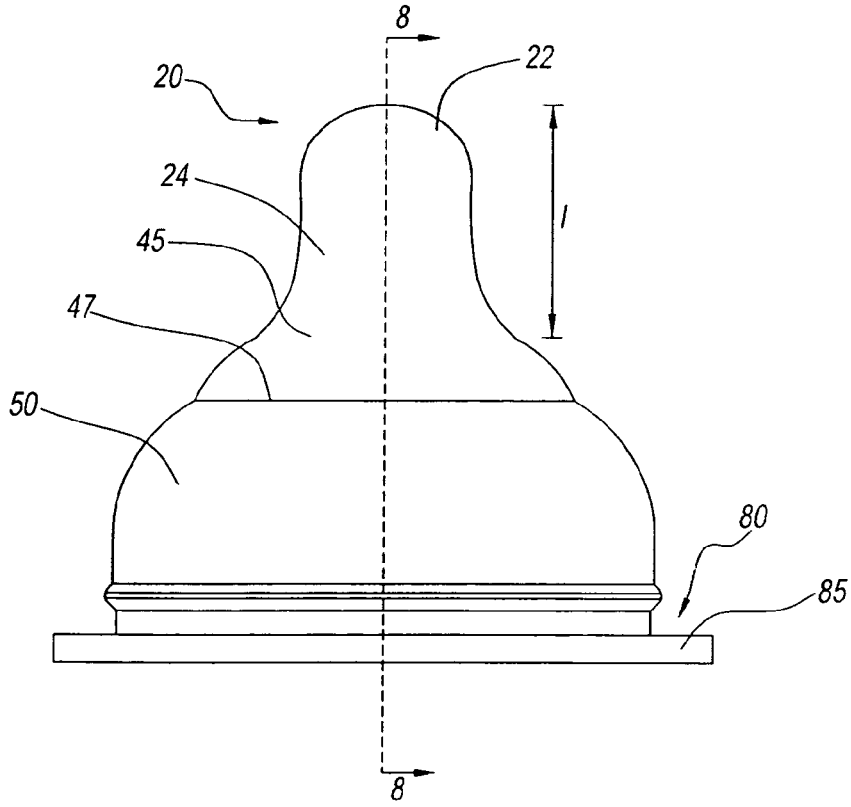
FIG. 7 is a plan view of the nipple of FIG. 4.
Figure 8:
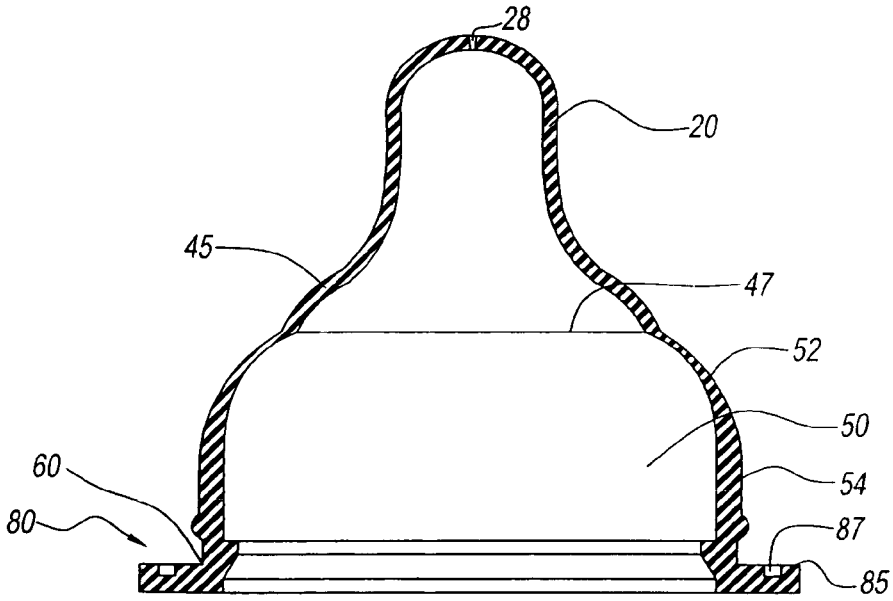
FIG. 8 is a cross sectional view of the nipple of FIG. 7 taken along line 8-8.

Referring to FIGS. 7 through 8, bulbous region 50 comprises an upper portion 52 and a lower portion 54. Upper portion 52 extends curvingly downward from areola edge 47. Preferably, upper portion 52 has a radius of curvature of about 10.0 mm to about 19.0 mm. More preferably, upper portion 52 has a radius of curvature of about 11.5 mm to about 14.0 mm. Lower portion 54 extends substantially vertically downward from upper portion 52.

Referring to FIGS. 4 and 8, upper portion 52 has a wall thickness that narrows towards areola edge 47. Preferably, the wall thickness of upper portion 52 gradually narrows towards areola edge 47. Upper portion 52 preferably has a minimum wall thickness of about 0.5 mm to about 1.0 mm. More preferably, upper portion 52 has a minimum wall thickness of about 0.63 mm to about 0.89 mm. Preferably, lower portion 54 has a wall thickness of about 1.0 mm to about 2.1 mm. More preferably, lower portion 54 has a wall thickness of about 1.3 mm to about 1.9 mm.

The narrowed wall thickness of upper portion 52 extends along the outside of areola region 45 to provide a flexibility to nipple 10 that allows areola region 45 and stem 20 to function more similarly to a woman's breast. When an axial force is applied to nipple 10 substantially along the center axis, i.e., the pushing and pulling force of the baby's sucking, the narrowed wall thickness of upper portion 52 allows areola region 45 and stem 20 to move substantially along the center axis in the direction of the applied force. This occurs because the narrowed wall thickness of upper portion 52 acts as a spring element. When the axial force is removed, areola region 45 and stem 20 return to their unbiased position.

Bulbous region 50 is connected to and surrounded by securing structure 80 along bulbous edge 60. Preferably, bulbous edge 60 is circular. More preferably, bulbous edge 60 has a diameter of about 38.0 mm to about 48.0 mm, and even more preferably a diameter of about 41.0 mm to about 45.0 mm. Preferably, bulbous region 50 is integrally formed with securing structure 80 along bulbous edge 60.

Securing structure 80 has a flange 85. Flange 85 extends outwardly from bulbous edge 60 and is preferably circular in shape. Preferably, flange 85 is integrally formed with and surrounds bulbous edge 60. Flange 85 extends from bulbous edge 60 about 3.5 mm to about 7.5 mm, and preferably about 4.5 mm to about 6.5 mm. Flange 85 allows a nipple ring or other securing device to sealingly engage nipple 10 to a baby bottle (not shown) through a downward compression force upon the upper surface of the flange against the rim or leading edge of the baby bottle. Flange 85 preferably has a securing channel 87 formed therein. Securing channel 87 is an annular groove on the upper surface of the flange. Securing channel 87 can be used for locking flange 85 to a nipple ring or other securing device that has an annular rib (not shown) aligned with and over the securing channel.

Nipple 10 is preferably made of silicone, latex, or other rubber materials. This material provides flexibility to nipple 10 that further simulates the function of a woman's breast during breast-feeding.

For example, nipple 10 can be positioned between a nipple ring having a concentric hole, internal threads and an annular ring on its lower surface (not shown), and a baby bottle having external threads on its top (not shown). The nipple ring can then be threadingly secured to the baby bottle causing a compressive force to be exerted on flange 85 by the nipple ring and leading edge or rim of the baby bottle. Securing channel 87 engages with the annular ring on the lower surface of the nipple ring (not shown) providing a further locking and sealing mechanism.

During breast-feeding, a baby latches on to the areola region of a woman's breast. The present invention provides areola region 45 on nipple 10 for a baby to latch on to. Conventional nipples, including the nipple disclosed in U.S. Pat. No. 5,653,732, fail to provide a single, distinct area that simulates the areola region. In providing such a region, the present invention provides a nipple that simulates a woman's breast during breast-feeding and reduces the difficulties associated with transitioning between breast-feeding and bottle-feeding. Additionally, during breast-feeding, the areola region of a woman's breast is pulled by the sucking force, resulting in inward and outward movement in the baby's mouth. The present invention further provides upper portion 52 that is a flexible region that causes areola region 45 of nipple 10 to inwardly and outwardly move when a sucking force is applied. In allowing such motion, the present invention provides a nipple that further simulates a woman's breast during breast-feeding and reduces the difficulties associated with transitioning between breast-feeding and bottle-feeding.

The present invention having been thus described with particular reference to the preferred forms thereof, it will be obvious that various changes and modifications may be made therein without departing from the spirit and scope of the present invention as defined in the appended claims.

What is claimed is:

1. A nipple for feeding of a baby comprising:

a stem having an orifice, a proximal end and a distal end, said stem being inwardly tapered toward said distal end;

an areola region being connected to said stem, said areola region having a first radius of curvature, said areola region and said proximal end of said stem being connected to form an inwardly concave surface, a transition from said areola region to said proximal end of said stem being smooth; and a bulbous region being connected to said areola region and surrounding said areola region, said bulbous region having a second radius of curvature, wherein said areola region is substantially concentrically aligned with said bulbous region when viewed in a top view, and wherein said first radius of curvature is different from said second radius of curvature.

2. The nipple of 1, wherein said first radius of curvature is substantially less than said second radius of curvature.

3. The nipple of 1, wherein said first radius of curvature is between about 5 mm to about 10 mm, and wherein said second radius of curvature is between about 10 mm to about 19 mm.

4. The nipple of 1, wherein said areola region is defined by an upper annular end and a lower annular edge, said upper annular end being substantially smooth, said lower annular edge being sharp.

5. The nipple of 4, wherein said areola region and said bulbous region have only one edge which is said lower annular edge.

6. The nipple of 1, wherein said proximal end of said stem has opposing sides with inwardly concave shapes when viewed in a front view.

7. The nipple of 1, further comprising a flange extending outwardly from said bulbous region, said flange having an annular channel formed therein.

8. The nipple of 1, wherein said stem has a length of about 16 mm to about 26 mm.

* * * * *